US009018930B2

(12) United States Patent
Zambetti

(10) Patent No.: US 9,018,930 B2
(45) Date of Patent: Apr. 28, 2015

(54) CURRENT GENERATOR FOR TEMPERATURE COMPENSATION

(75) Inventor: Osvaldo Enrico Zambetti, Milan (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 438 days.

(21) Appl. No.: 13/333,860

(22) Filed: Dec. 21, 2011

(65) Prior Publication Data

US 2012/0161741 A1 Jun. 28, 2012

(30) Foreign Application Priority Data

Dec. 23, 2010 (IT) ..... VA2010A0099

(51) Int. Cl.
*G05F 1/635* (2006.01)
*G05F 3/26* (2006.01)
*G05F 3/24* (2006.01)

(52) U.S. Cl.
CPC ..... *G05F 3/262* (2013.01); *G05F 3/245* (2013.01)

(58) Field of Classification Search
USPC ..... 323/313–315, 280, 294, 275, 282, 285; 327/536–540; 374/163, 170–172, 185
See application file for complete search history.

(56) References Cited

U.S. PATENT DOCUMENTS 4,347,474 A 8/1982 Brooks et al.
5,319,536 A 6/1994 Malik
5,559,423 A * 9/1996 Harman ..... 323/277
5,603,138 A 2/1997 Bonis
6,137,702 A 10/2000 Hall et al.
6,362,608 B1 3/2002 Ashburn et al.
6,483,383 B2 11/2002 Wu
6,759,893 B2 7/2004 Gailhard et al.
7,057,381 B2 6/2006 Harriman et al.
7,061,215 B2 6/2006 Harris
7,274,174 B2 * 9/2007 Wang et al. ..... 323/224

(Continued)

FOREIGN PATENT DOCUMENTS

EP 1696215 A1 8/2006
KR 20080022799 A 3/2008

(Continued)

OTHER PUBLICATIONS

Julsereewong et al., "Buck Converter Controlled by Using Variable Switching Frequency Technique", Electron Devices and Solid-State Circuits, 2008. EDSSC 2008. IEEE International Conference On, IEEE, Piscataway, NJ, USA, Dec. 8-10, 2008, 4 pages.

(Continued)

*Primary Examiner* — Adolf Berhane
*Assistant Examiner* — Henry Lee, III
(74) *Attorney, Agent, or Firm* — Seed IP Law Group PLLC

(57) ABSTRACT

A current generator includes a thermistor configured to receive an input current, a reference resistor having a resistance substantially corresponding to a resistance of said thermistor at a reference temperature, a current mirror configured to generate a mirrored current proportional to said input current, a feedback circuit configured to generate an output compensation current proportional to a difference between voltages on said reference resistor and on said thermistor, and a first adder configured to force through said reference resistor a difference current between said mirrored replica current and said output compensation current.

17 Claims, 5 Drawing Sheets

(56) References Cited

U.S. PATENT DOCUMENTS

| | | | | |
|---|---|---|---|---|
| 7,279,875 | B2 | 10/2007 | Gan et al. | |
| 7,679,350 | B2 | 3/2010 | Falvey et al. | |
| 7,796,411 | B2 | 9/2010 | Jin et al. | |
| 8,102,164 | B2 | 1/2012 | Colbeck et al. | |
| 8,237,376 | B2 | 8/2012 | Franco | |
| 2002/0190734 | A1* | 12/2002 | Burt et al. | 324/713 |
| 2003/0111984 | A1* | 6/2003 | Isham | 323/271 |
| 2005/0184717 | A1 | 8/2005 | Walters | |
| 2007/0108954 | A1 | 5/2007 | Qiu et al. | |
| 2007/0229048 | A1 | 10/2007 | Zambetti et al. | |
| 2008/0024104 | A1 | 1/2008 | Yamada | |
| 2008/0129259 | A1 | 6/2008 | Endo et al. | |
| 2009/0257164 | A1* | 10/2009 | Ikeuchi et al. | 361/91.5 |
| 2010/0079127 | A1* | 4/2010 | Grant | 323/285 |
| 2010/0191980 | A1 | 7/2010 | Malzahn et al. | |
| 2010/0231190 | A1 | 9/2010 | Falvey et al. | |
| 2010/0315052 | A1 | 12/2010 | Zambetti et al. | |
| 2012/0153869 | A1 | 6/2012 | Sadwick et al. | |
| 2013/0293210 | A1 | 11/2013 | Smith et al. | |

FOREIGN PATENT DOCUMENTS

| | | | |
|---|---|---|---|
| WO | 9406030 | A1 | 3/1994 |
| WO | 9950731 | A1 | 10/1999 |

OTHER PUBLICATIONS

Pengfei et al., "A 90 240 MHz Hysteretic Controlled DC-DC Buck Converter with Digital Phase Locked Loop Synchronization," *IEEE Journal of Solid-State Circuits* 46(9):2108-2119, Sep. 2011.

* cited by examiner

CURRENT GENERATOR FOR TEMPERATURE COMPENSATION

BACKGROUND

1. Technical Field

This disclosure relates to current generators and more particularly to a temperature compensation generator for a current to be compensated in function of the difference between current temperature and a reference temperature.

2. Description of the Related Art

Central processing units (CPUs) for personal computers (PCs), workstations and servers have very sophisticated supply control mechanisms. Their power supplies meet high precision specifications both in stand-by conditions as well as in conditions of load transients. It is known that, in order to reduce costs of the output filter of these systems, "voltage position" techniques, called also "droop function" or "load line regulation" based on programming the output resistance of the power supply converter, are often used.

In order to prevent avoidable power dissipations and to sense the output current in a sufficiently refined and continuous manner, the parasitic conduction resistance DCR of the output inductor is used as sense resistance.

FIG. 1 depicts a simplified block diagram of a typical three-phase buck converter. The meaning of each functional block is summarized in the following table:

| | |
|---|---|
| INTERLEAVING OSCILLATOR | Oscillator that generates time outphased pulses for resetting ramp signals |
| RAMP1, RAMP2, . . . , RAMPN | ramp signals mutually phase shifted among them |
| MULTIPHASE PWM GENERATOR | generator of PWM signals mutually phase shifted among them |
| PWM1, PWM2, PWMN | PWM signals mutually phase shifted among them |
| MOS DRIVER | driving circuit of a power MOS stage |
| VIN | supply voltage |
| L1, L2, . . . , LN | output inductors |
| VOUT | output voltage |
| COUT | output tank capacitance |
| IINFO1, IINFO2, . . . , IINFON | reference currents of the single phases |
| CURRENT SHARING CONTROL | circuit for generating voltages corresponding to the desired reference currents |
| VBALANCE_1, VBALANCE_2, . . . , VBALANCE_N | voltages corresponding to the desired reference currents |
| ERROR AMPLIFIER | error amplifier |
| REF | reference voltage |
| IDROOP | current proportional to the current supplied to the load |
| ZF | resistance |
| ZFB | feedback resistance |

In these multiphase systems, the output current of the buck converter is sensed in order to generate the desired load line. Moreover if one knows the current flowing through each channel one can implement a so-called current sharing between the phases of the system and equalize the current flowing throughout each phase for preventing stresses and damages to components.

The main problem in sensing the current on the conduction resistance DCR of the output coil is that its resistance depends on temperature. The temperature coefficient $\alpha$ of copper is about 0.39%, thus even small temperature fluctuations may generate relevant errors in sensing the delivered current.

The voltage read on the inductor, for example through TCM (Time Constant Matching) techniques, well known in literature, is as follows:

$$V_{DCR1}=I_L \cdot DCR_{25} \cdot [1+\alpha(T-25)]$$

and the current ISENSE read for a single channel by the device is $$I_{SENSE1} = I_L \cdot \frac{DCR_{25}}{R_G} \cdot [1 + \alpha(T - 25)]$$

$R_G$ being the design resistance of the current sensing. Being $$I_{INFO} = I_L \cdot \frac{DCR_{25}}{R_G}$$

then $$I_{SENSE1}=I_{INFO1} \cdot [1+\alpha(T-25)].$$

For temperature compensating N currents, an equal number of thermistors, for example of NTC (Negative Temperature Coefficient) type, would be used. However, because NTC thermistors are relatively expensive, a single NTC sensing for the sum of the currents (IDROOP) is generally performed such to compensate an average temperature of the N phases. In order to do that without using additional pins, the thermistor is generally introduced in the compensation network, in place of or combined with the ZFB resistance, as shown in FIG. 2, that realizes the so-called droop function.

In FIG. 2, the block MODULATOR indicates generically the PWM signal generator and the drivers of the power stages, the block CURRENT AND THERMAL MONITOR sense the thermally compensated output current and the working temperature, and converts them in digital form for outputting the desired information, and the current ISENSE is the sum of the currents of all the phases: Iinfo1,. . . , IinfoN.

This cost saving expedient has many drawbacks:

- compensation and thus the stability of the system depends on temperature;
- should another thermally compensated temperature signal be desired for another use (for example the monitoring of the output current IMON), an additional thermistor would be used;
- should a motherboard temperature measure (TM) be desired, a further additional thermistor would be used, with relevant increase of costs.

A circuit that obviates to these drawbacks, disclosed by Intersil, contemplates the use of a single NTC. The solution is based on the mapping of the temperature characteristic of a known sensor. Once the temperature characteristic is known, the sensed current is corrected and this correction (that will depend upon the temperature) may be used for the various operations to be performed on the sensed current (droop function, current monitor and current sharing).

A drawback of this solution consists in that the characteristic of the sensor must be known and mapped on silicon in order to gather the correct temperature value.

BRIEF SUMMARY

An architecture of a current generator has been found that makes it capable of generating a temperature compensation current depending upon an input current to be compensated, without knowing the temperature characteristic of the NTC and have it mapped on silicon.

The compensation current is generated in function of the input current to be compensated by comparing the voltage drop on a thermistor caused by the current to be compensated, with a voltage drop on a resistance, corresponding to the resistance of the thermistor at the reference temperature, caused by a current that is the algebraic sum of the current to be compensated and of the compensation current.

In other words, the current generator for temperature compensation of novel architecture of this disclosure is adapted to receive an input current to be compensated in function of the difference between a temperature of an environment and a reference temperature and to generate a corresponding output compensation current, and comprises a thermistor installed in the environment that is crossed by the current to be compensated, a reference resistor of a value corresponding to the resistance of the thermistor at the reference temperature, a current mirror adapted to generate a replica current of the input current to be compensated, at least a feedback circuit adapted to generate the output compensation current proportional to the difference between the voltages on the reference resistor and on the thermistor, and an adder circuit adapted to force throughout the reference resistor a difference current between the mirrored replica current of the current to be thermally compensated and the output current.

The generated compensation current may be replicated by one or more transconductance amplifiers and delivered to as many circuits that would benefit from temperature compensation, using a single thermistor.

The novel compensation current generator architecture may be realized in analog or in digital form.

DETAILED DESCRIPTION

Figure 3:
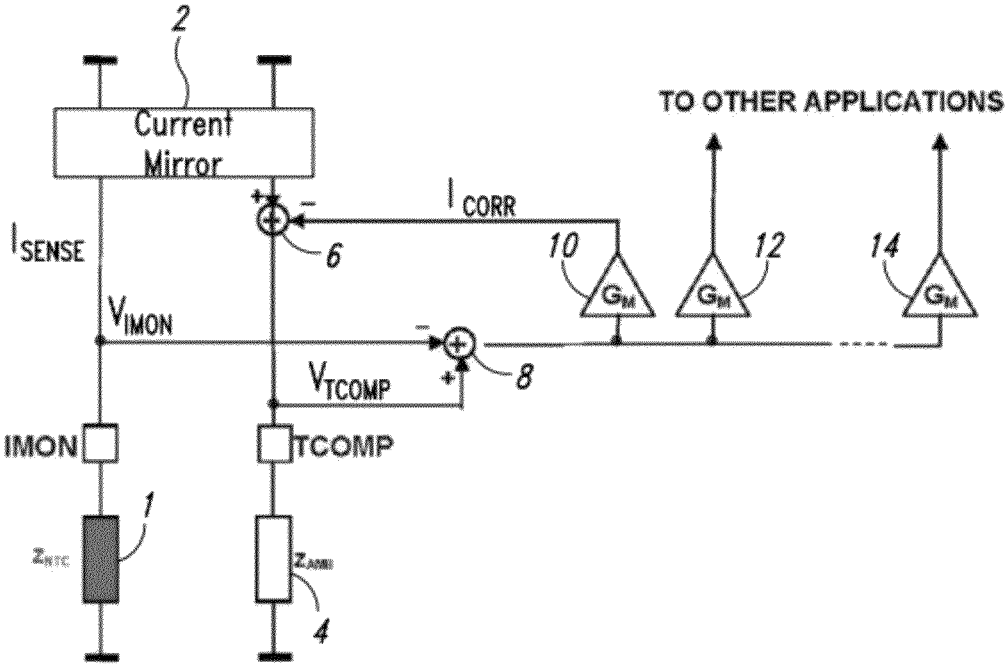
FIG. 3 depicts an analog embodiment of the novel current generator for temperature compensation.

A novel compensation current generator according to one embodiment of the present disclosure is shown in FIG. 3. The current generator uses a single NTC thermistor 1 (in particular having a thermal compensation impedance $Z_{NTC}$) in order to compensate on a pin IMON a temperature varying input current ($I_{SENSE}$).

The voltage $V_{IMON}$ available on this pin is thus:

$$V_{IMON}=I_{SENSE}\cdot Z_{AMB}\cdot[1-\beta(T-T_{AMB})]$$

wherein β represent the equivalent temperature coefficient of the impedance $Z_{NTC}$ of the thermistor 1 and $Z_{AMB}$ represents the equivalent resistance of the thermistor at reference room temperature.

The current generator includes a current mirror 2 configured to generate a replica current that is equal to the input current ISENSE, a resistor 4 having an impedance $Z_{AMB}$ that is equivalent to the impedance of the thermistor 1 at room temperature, and an adder 6 configured to provide, through another pin TCOMP a difference current given by the difference between the current $I_{SENSE}$ and a compensation current $I_{CORR}$. The difference current is forced through the resistor 4 to produce a voltage $V_{TCOMP}$:

$$V_{TCOMP}=(I_{SENSE}-I_{CORR})\cdot Z_{AMB}.$$

The current generator also includes a voltage adder 8, having inputs coupled to the IMON and TCOMP pins, respectively, and configured to provide an output voltage equal to the difference between the voltage $V_{TCOMP}$ and the voltage $V_{IMON}$. A transconductance amplifier 10 has an input coupled to the output of the voltage adder 8 and an output coupled to an input of the current adder 6 and is configured to generate to generate the compensation current $I_{CORR}$ proportionally to the difference between the voltage $V_{TCOMP}$ and the voltage $V_{IMON}$. The current generator also includes additional transconductance amplifiers 12, 14 configured to provide compensation current to other circuits, such as for a motherboard temperature measurement, that could benefit from such a temperature-compensated current generator.

Figure 4:
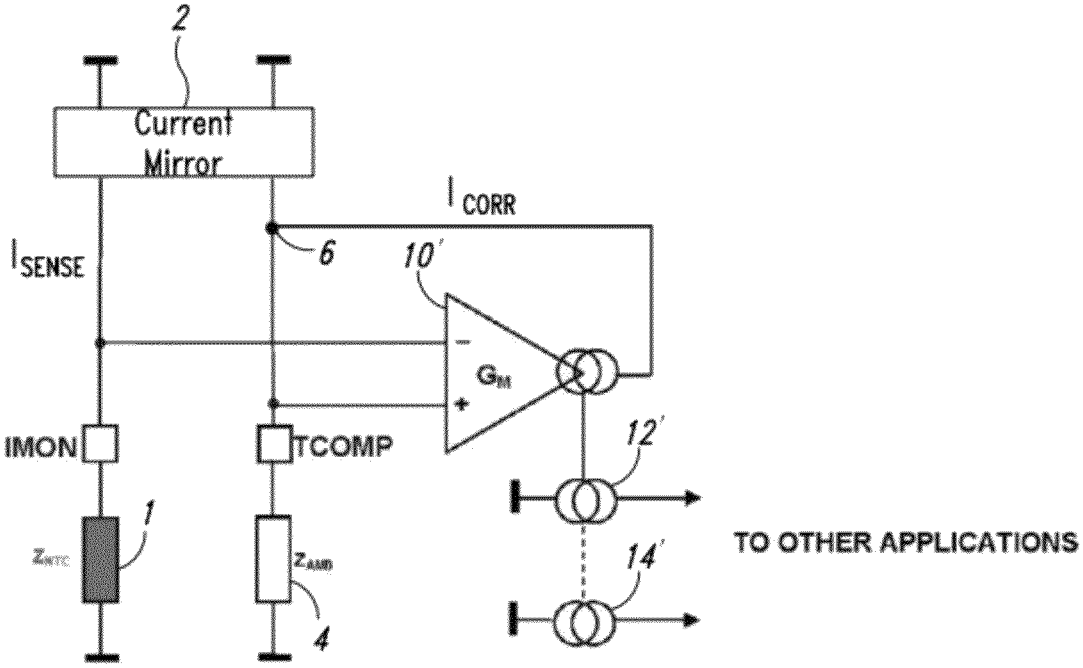
FIG. 4 depicts another analog embodiment of the novel current generator for temperature compensation.
Figure 5:
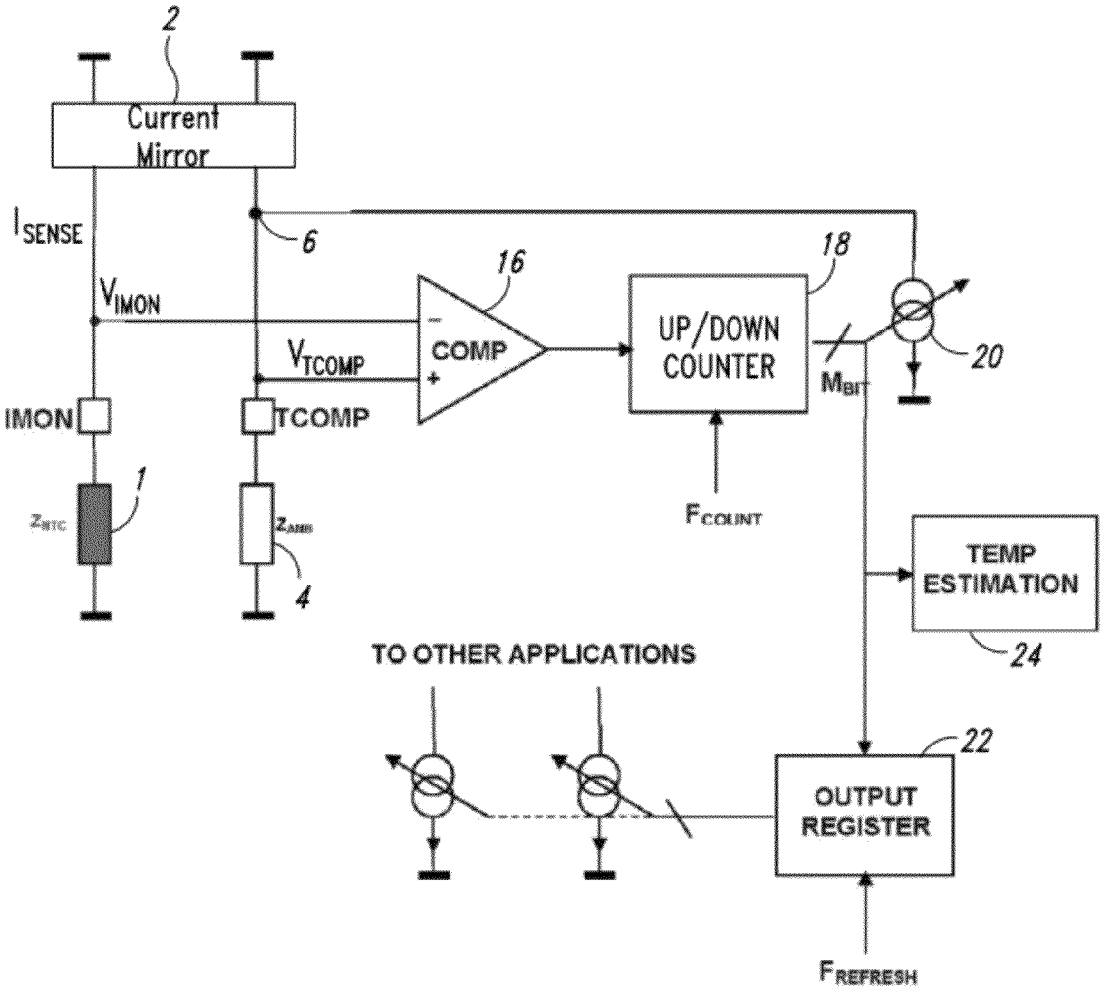
FIG. 5 depicts another digital embodiment of the novel current generator for temperature compensation.

According to one embodiment of the disclosure, this compensation current $I_{CORR}$ can be generated with an analog circuit shown in FIG. 4, or with a digital circuit shown in FIG. 5.

The analog circuit of FIG. 4 is similar to the analog circuit of FIG. 3 except that the analog circuit of FIG. 4 includes a transconductance amplifier 10' that has first and second inputs coupled directly to the IMON and TCOMP pins, rather than through the voltage adder 8 of FIG. 3. The two voltages $V_{IMON}$ and $V_{TCOMP}$ are input to the transconductance amplifier 10' which generates the output compensation current $I_{CORR}$ proportional to the difference of the two inputs:

$$I_{CORR}=G_{M'}(V_{TCOMP}-V_{IMON}).$$

The current $I_{CORR}$ is subtracted from the current $I_{SENSE}$ by the adder 6, which can simply be a connection node between the outputs of the current mirror 6 and transconductance amplifier 10' and the TCOMP pin. The feedback loop makes the two voltages $V_{IMON}$ and $V_{TCOMP}$ equal to each other (virtually shorted), the compensation current $I_{CORR}$ may be replicated any number of times, such as by transconductance amplifiers 12' and 14', for temperature compensating a plurality of currents $I_{SENSE}$ using a single thermistor.

In the digital circuit of FIG. 5, the two voltages $V_{IMON}$ and $V_{TCOMP}$ are applied to the input terminals of a comparator 16, the output of the comparator is sent to an up/down counter 18 that counts up if the output of the comparator is 1 and counts down if the output of the comparator is 0.

The binary output (a value N) of this counter 18 with M bits fixes the mirror ratio of a correction current $I_{CORR}$ produced by a digitally controlled current source 20:

$$I_{CORR}=\frac{N}{M}\cdot I_{SENSE}$$

that is subtracted from the current $I_{SENSE}$ on the pin TCOMP.

The frequency of clock pulses $F_{COUNT}$ counted by the UP/DOWN counter 18 may be set as desired and establishes the accuracy with which the voltage $V_{TCOMP}$ follows the voltage $V_{IMON}$ This frequency may be properly dimensioned depending on the maximum variation speed of the current $I_{SENSE}$ in function of temperature.

If desired, an output register 22 may be dedicated for outputting a correction bit stream at the desired frequency for correcting the current $I_{SENSE}$ for other applications.

Digital solutions have the great advantage that the correction current is directly obtained from the current $I_{SENSE}$. This allows the system to maintain the best thermal correction even during fast transients of $I_{SENSE}$ such as for example in applications for supplying microprocessors. Moreover, the digital solution of FIG. 5 may include a temperature estimator 24 configured to estimate the functioning temperature of the system because:

$$V_{IMON}=V_{TCOMP}$$

that is:

$$I_{SENSE}\cdot Z_{AMB}\cdot[1-\beta(T-T_{AMB})]=\left(I_{SENSE}-\frac{N}{2^M}\cdot I_{SENSE}\right)\cdot Z_{AMB}$$

from which:

$$\beta(T-T_{AMB})=\frac{N}{2^M}$$

and thus, in general:

$$T=\frac{N}{\beta\cdot 2^M}+T_{AMB}$$

If for example β=0.39% as in the case of copper and an up/down counter with 8 bits is used, it is possible to rewrite the previous formula as follows:

$$T=N+T_{AMB}$$

that is very simple to be implemented.

Figure 1:
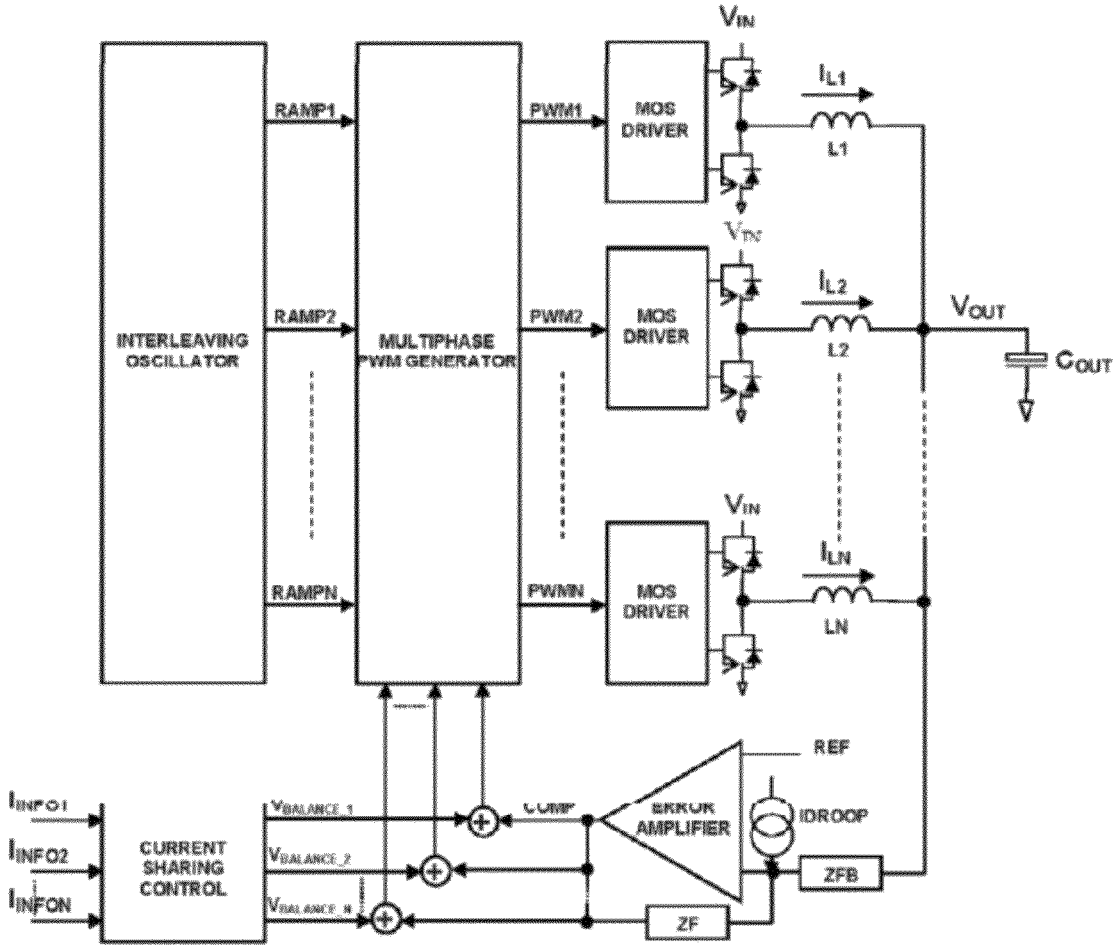
FIG. 1 (Prior Art)
FIG. 1 depicts a typical multi-phase converter.
Figure 2:
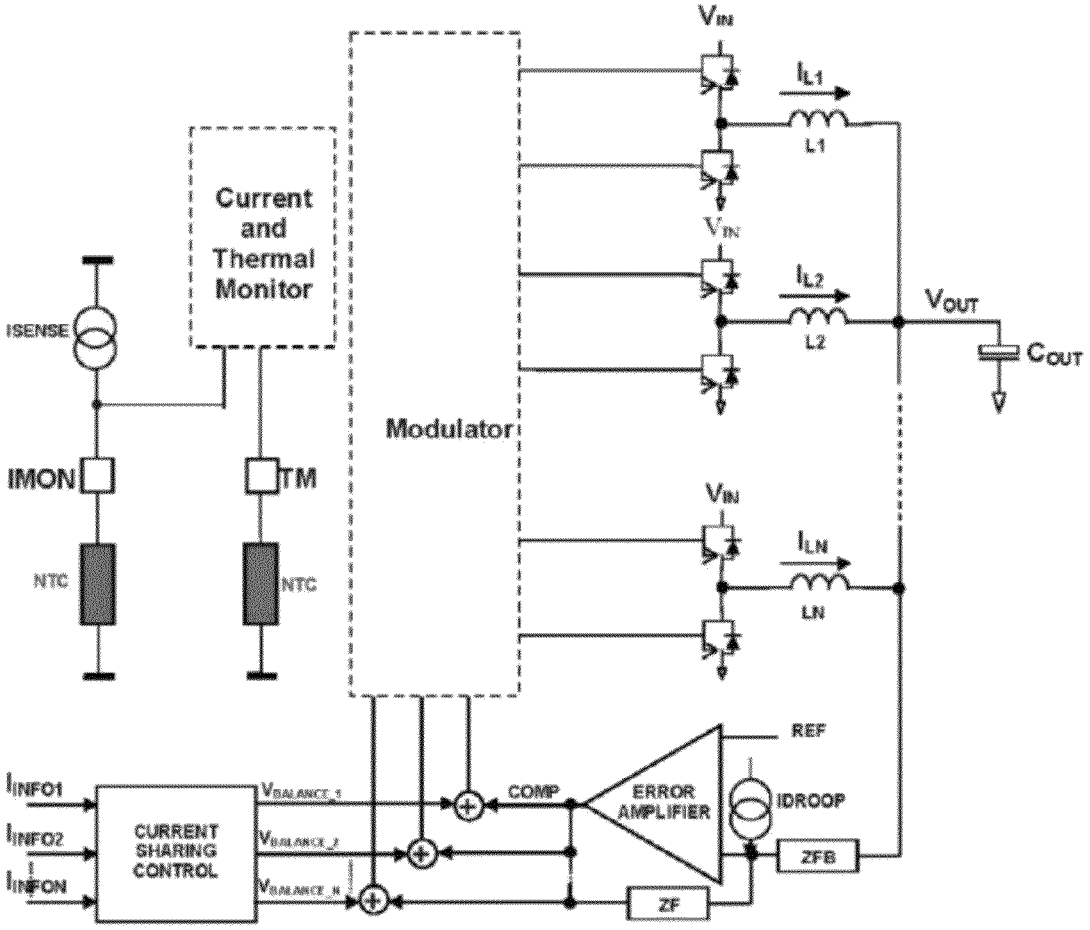
FIG. 2 (Prior Art)
FIG. 2 depicts a known multi-phase converter the feedback resistance of which ZFB contains or is composed of a thermistor, using two further thermistors.
Figure 6:
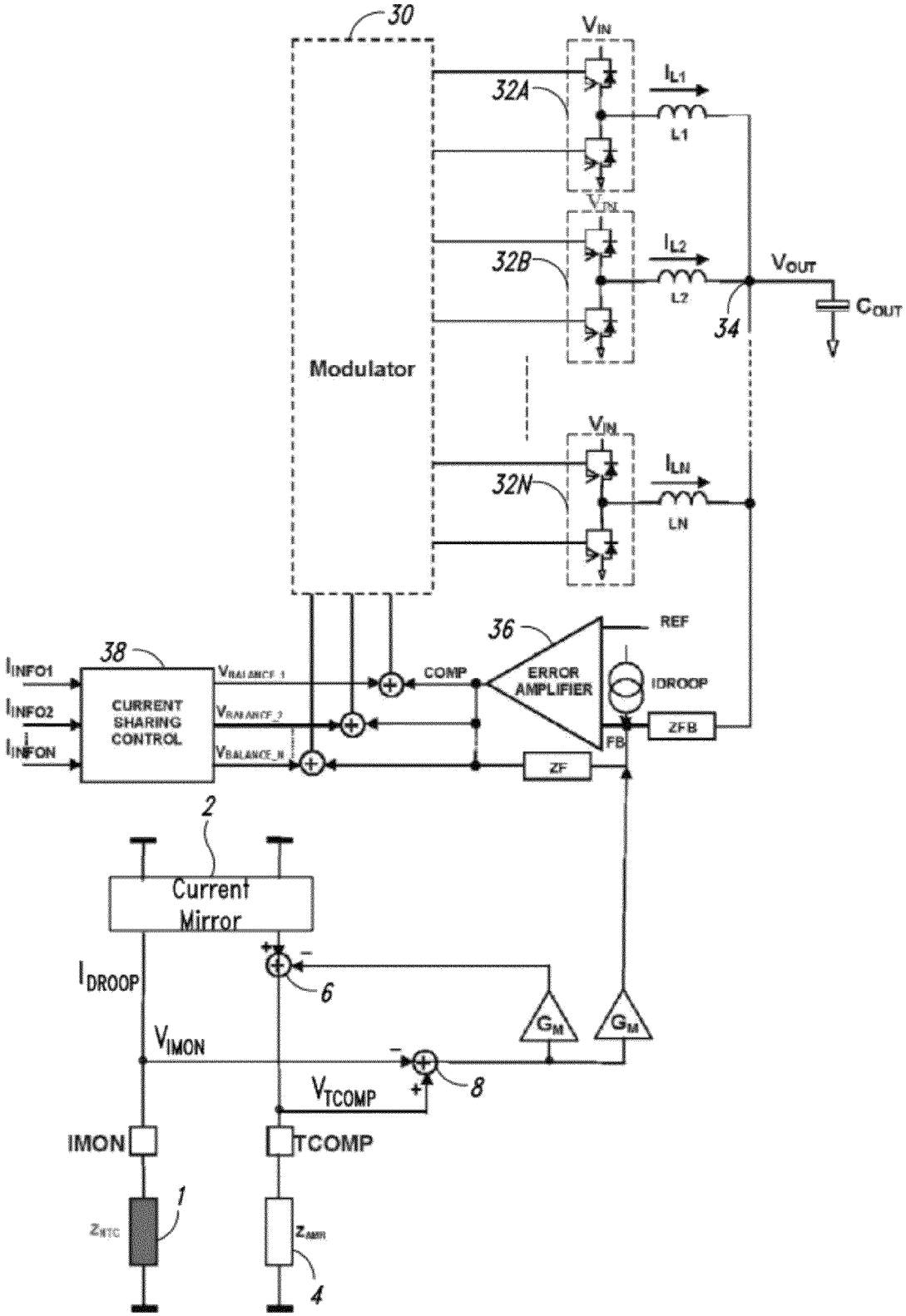
FIG. 6 depicts a novel multi-phase converter that uses the novel current generator for temperature compensation of FIG. 3.

A multi-phase converter that includes the novel compensation current generator of FIG. 3 is shown in FIG. 6. The converter includes a modulator 30 which includes a PWM signal generator and MOS drivers (such as those shown in FIG. 1) for driving power stages 32A, 32B, . . . , 32N. The power stages respectively provide currents $I_{L1}, I_{L2}, \ldots, I_{LN}$ to a set of output inductors L1, L2, . . . , LN coupled together at an output terminal 34 that provides an output voltage $V_{OUT}$ to an output tank capacitance $C_{OUT}$.

Coupled to the output terminal 34 via a feedback resistor ZFB is a first input terminal of an error amplifier 36, which has a second input terminal coupled to a reference voltage REF and an output terminal coupled to the first input terminal by a resistor ZF. Coupled to the output terminal of the error amplifier 36 are three adders 38 that also have inputs coupled to a current sharing controller 38 and outputs coupled to the modulator 30. The current sharing controller 38 is configured to generate reference voltages $V_{BALANCE1}$, $V_{BALANCE2}$, $V_{BALANCE3}$ corresponding to desired references currents $I_{INFO1}$, $I_{INFO2}$, $I_{INFO3}$ for the respective phases.

The current IDROOP is the total current delivered by the converter to the output $V_{OUT}$. It is generally read on the output coils L1, L2, L3 by exploiting their parasitic resistances DCR. Being made of copper in one embodiment, the value of each DCR is not constant with temperature and thus the current IDROOP undergoes to relevant variations when the temperature varies.

With the novel compensation current generator it is possible to generate a voltage (on the node IMON) representative of the delivered current IDROOP, compensated by taking into account the temperature variations of the inductors L1, L2, L3 of the converter and, using the same thermistor 1, by generating a correction current that may be injected on the node FB for obtaining the desired droop function (voltage positioning or load line), desired in many voltage regulator module (VRM) applications, such as those for supplying CPUs. Moreover, it is not necessary to insert a thermistor inside the feedback loop of the multi-phase converter.

The claims as filed are integral part of this description and are herein incorporated by reference.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A current generator, comprising:

a thermistor configured to receive an input current;

a reference resistor having a resistance substantially equal to a resistance of said thermistor at a reference temperature;

a current mirror configured to generate a mirrored current proportional to said input current;

a feedback circuit having inputs electrically coupled to the thermistor and reference resistor, the feedback circuit being configured to generate an output compensation current proportional to a difference between voltages on said reference resistor and on said thermistor; and a first adder having an input configured to be fed back the output compensation current from the feedback circuit, and an output electrically coupled to one of the inputs of the feedback circuit, the first adder being configured to apply to said reference resistor a difference current corresponding to a difference between said mirrored current and said output compensation current.

2. The current generator of claim 1, wherein said feedback circuit comprises a transconductance amplifier configured to generate said output compensation current proportional to the difference between voltages on said reference resistor and on said thermistor.

3. The current generator of claim 1, wherein said feedback circuit comprises:

a comparator coupled to said thermistor and to said reference resistor, configured to generate a first logic value in response to detecting that the voltage on said reference resistor is greater than the voltage on said thermistor and configured to generate a second logic value is response to detecting that the voltage on said reference resistor is not greater than the voltage on said thermistor;

an up/down counter configured to count up pulses of a clock signal in response to receiving the first logic value from the comparator, to count down pulses of the clock signal in response to receiving the second logic value from the comparator, and to generate a counting value;

an adjustable current generator coupled to said up and down counter configured to generate said output current corresponding to said counting value.

4. The current generator of claim 3, comprising a digital temperature estimator configured to receive said counting value and estimate an ambient temperature.

5. The current generator of claim 3, comprising a plurality of adjustable current generators coupled to said up and down counter and configured to respectively generate respective output currents corresponding to said counting value.

6. The current generator according to claim 1, comprising a transconductance amplifier to generate an output current proportional to the difference between voltages on said reference resistor and on said thermistor.

7. The current generator of claim 1, comprising a plurality of transconductance amplifiers respectively configured to generate output currents proportional to the difference between the voltages on said reference resistor and on said thermistor.

8. The current generator of claim 1, comprising a second adder having a first input coupled to the thermistor, a second input coupled to the reference resistor, and an output coupled to an input of the feedback circuit, the second adder being configured to provide a voltage corresponding to the difference between voltages on said reference resistor and on said thermistor.

9. The current generator of claim 1, wherein the first adder is an adder node.

10. A DC-DC converter, comprising:

an output stage configured to provide an output current; and a current generator coupled to the output stage, the current generator including:

a thermistor configured to receive an input current that is proportional to the output current;

a reference resistor having a resistance substantially equal to a resistance of said thermistor at a reference temperature;

a current mirror configured to generate a mirrored current proportional to said input current;

a feedback circuit having inputs electrically coupled to the thermistor and reference resistor, respectively, the feedback circuit being configured to generate a first compensation current proportional to a difference between voltages on said reference resistor and on said thermistor; and a first adder having an input configured to be fed back the output compensation current from the feedback circuit, and an output electrically coupled to one of the inputs of the feedback circuit, the first adder being configured to apply to said reference resistor a difference current corresponding to a difference between said mirrored current and said first compensation current.

11. The DC-DC converter of claim 10, wherein said feedback circuit comprises a first transconductance amplifier configured to generate said output compensation current proportional to the difference between voltages on said reference resistor and on said thermistor.

12. The DC-DC converter of claim 11, further comprising:

a controller configured to control the output stage; and an error amplifier coupled between the output stage and the controller, wherein said current generator comprises a second transconductance amplifier configured to generate a second compensation current, proportional to the difference between voltages on said reference resistor and on said thermistor, and provide the second compensation current to the error amplifier.

13. The DC-DC converter of claim 10, wherein said feedback circuit comprises:

a comparator coupled to said thermistor and to said reference resistor, configured to generate a first logic value in response to detecting that the voltage on said reference resistor is greater than the voltage on said thermistor and configured to generate a second logic value is response to detecting that the voltage on said reference resistor is not greater than the voltage on said thermistor;

an up/down counter configured to count up pulses of a clock signal in response to receiving the first logic value from the comparator, to count down pulses of the clock signal in response to receiving the second logic value from the comparator, and to generate a counting value;

an adjustable current generator coupled to said up and down counter configured to generate said output current corresponding to said counting value.

14. The DC-DC converter of claim 13, wherein the current generator includes a plurality of adjustable current generators coupled to said up and down counter and configured to respectively generate respective output currents corresponding to said counting value.

15. The DC-DC converter of claim 10, wherein the current generator includes a plurality of transconductance amplifiers respectively configured to generate compensated currents proportional to the difference between the voltages on said reference resistor and on said thermistor.

16. The DC-DC converter of claim 10, wherein the current generator includes a second adder having a first input coupled to the thermistor, a second input coupled to the reference resistor, and an output coupled to an input of the feedback circuit, the second adder being configured to provide a voltage corresponding to the difference between voltages on said reference resistor and on said thermistor.

17. The DC-DC converter of claim 10, wherein the first adder is an adder node.

* * * * *